US011761050B2

(12) United States Patent
Yang et al.

(10) Patent No.: US 11,761,050 B2
(45) Date of Patent: Sep. 19, 2023

(54) HIGH-STRENGTH LOW-CARBON BAINITIC FIRE-RESISTANT STEEL AND PREPARATION METHOD THEREOF

(71) Applicants: Central Iron & Steel Research Institute, Beijing (CN); Advanced Steel Technology Co., Ltd., Beijing (CN)

(72) Inventors: Zhongmin Yang, Beijing (CN); Jingjing Du, Beijing (CN); Ying Chen, Beijing (CN); Huimin Wang, Beijing (CN); Zhaodong Li, Beijing (CN); Yanguang Cao, Beijing (CN)

(73) Assignee: CENTRAL IRON & STEEL RESEARCH INSTITUTE, Beijing (CN)

( * ) Notice: Subject to any disclaimer, the term of this patent is extended or adjusted under 35 U.S.C. 154(b) by 23 days.

(21) Appl. No.: 17/340,644

(22) Filed: Jun. 7, 2021

(65) Prior Publication Data

US 2021/0395849 A1 Dec. 23, 2021

(30) Foreign Application Priority Data

Jun. 19, 2020 (CN) ..... 202010570427.0

(51) Int. Cl.
*C21D 8/02* (2006.01)
*C21D 1/28* (2006.01)
(Continued)

(52) U.S. Cl.
CPC ..... *C21D 8/0226* (2013.01); *C21D 1/28* (2013.01); *C22C 38/02* (2013.01); *C22C 38/04* (2013.01);
(Continued)

(58) Field of Classification Search
CPC ..... C21D 9/28
See application file for complete search history.

(56) References Cited

U.S. PATENT DOCUMENTS 5,454,883 A * 10/1995 Yoshie ..... C21D 8/0263 148/661
2011/0002808 A1 1/2011 Mizoguchi et al.

FOREIGN PATENT DOCUMENTS

CN 101818312 A 9/2010
CN 101855379 A 10/2010
(Continued)

OTHER PUBLICATIONS

Chinese Office Action dated Mar. 3, 2021 for CN Application No. 202010570427.0, 9 pages.
(Continued)

*Primary Examiner* — Alexandra M Moore
(74) *Attorney, Agent, or Firm* — Christopher J. Korff

(57) ABSTRACT

A high-strength low-carbon bainitic fire-resistant steel and a preparation method thereof, belong to the technical field of low-carbon air-cooled bainitic fire-resistant steels. The problems of low yield strength, complicated production process and poor high-temperature mechanical properties of the fire-resistant steel in the prior art are solved herewith. The high-strength low-carbon bainitic fire-resistant steel disclosed herein have chemical components by mass percent of: 0.07%-0.1% of C, 0.7%-0.9% of Si, 1.0%-1.5% of Mn, 0.7%-0.8% of Cr, 1.0%-1.3% of Ni, 0.3%-0.35% of Cu, 0.6%-0.8% of Mo, 0.025%-0.035% of Nb, 0.09%-0.15% of V, 0.01%-0.015% of Ti, <0.2% of Nb+V+Ti, <0.02% of Alt, <0.003% of S, <0.008% of P, and the balance is Fe and inevitable impurities. Improvements are realized in the yield strength and high-temperature mechanical properties of the fire-resistant steel.

6 Claims, 3 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *C21D 6/00* | (2006.01) |
| *C21D 7/13* | (2006.01) |

(52) U.S. Cl.

CPC ..... *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 6/004* (2013.01); *C21D 6/005* (2013.01); *C21D 6/008* (2013.01); *C21D 7/13* (2013.01); *C21D 8/021* (2013.01); *C21D 8/0205* (2013.01); *C21D 2211/002* (2013.01)

(56) References Cited

FOREIGN PATENT DOCUMENTS

| | | | |
|---|---|---|---|
| CN | 103695773 | A | 4/2014 |
| CN | 103710622 | A | 4/2014 |
| CN | 109628712 | A | 4/2019 |
| CN | 109628836 | A | 4/2019 |
| CN | 111154962 | A | 5/2020 |
| JP | H08-35036 | A | 2/1996 |

OTHER PUBLICATIONS

Espacenet Bibliographic data for CN 103710622 A, downloaded Jun. 7, 2021, 1 page.
Espacenet Bibliographic data for CN103695773A, downloaded Jun. 7, 2021, 1 page.
Espacenet Bibliographic data for CN109628836A, downloaded Jun. 7, 2021, 2 pages.
Espacenet Bibliographic data for JPH08-35036A, downloaded Jun. 7, 2021, 1 page.
Espacenet Bibliographic data for CN111154962A, downloaded Jun. 7, 2021, 2 pages.
Espacenet Bibliographic data for CN109628712A, downloaded Jun. 7, 2021, 1 page.
Espacenet Bibliographic data for CN101818312A, downloaded Jun. 7, 2021, 2 pages.
Espacenet Bibliographic data for CN101855379A, downloaded Jun. 7, 2021, 2 pages.
Ben She, Yi Ming, "Steel", Published by China Electric Power Press, pp. 31-34; ISBN 7-5083-1687-8; (2004), 6 pages.
English Translation of "Steel", Published by China Electric Power Press, submitted in the Information Disclosure Statement dated June, 7, 2021, 7 pages.
English Translation of CN OA issued Mar. 3, 2021 for CN Application No. 202010570427.0, previously submitted in the Information Disclosure Statement dated June, 7, 2021, 10 pages.

* cited by examiner

HIGH-STRENGTH LOW-CARBON BAINITIC FIRE-RESISTANT STEEL AND PREPARATION METHOD THEREOF

CROSS-REFERENCE TO RELATED APPLICATIONS

This application claims priority to Chinese Patent Application No. 202010570427.0, filed on Jun. 19, 2020, which is hereby incorporated by reference in their entirety.

TECHNICAL FIELD

The present disclosure relates to the technical field of low-carbon air-cooled bainitic fire-resistant steels, in particular to a high-strength low-carbon bainitic fire-resistant steel and a preparation method thereof.

BACKGROUND

With the rapid development of the modern construction industry, the traditional method of improving the fire resistance of the building material through the surface fire-resistant coating is gradually being abandoned. The main reason is that the surface fire-resistant coating has a high preparation cost, and has an adverse effect on people's health and the environment. Therefore, people are gradually trying to improve the fire resistance of the building material from the building material itself, and one of the important directions is to strengthen the development of fire-resistant steel. Fire-resistant steel typically refers to engineering structural steel that has a larger yield strength in 1-3 h at 600° C. than ⅔ of that at room temperature. It is used for fire protection and collapse resistance for steel structure buildings or high-rise large buildings.

The high-temperature mechanical properties of the fire-resistant steel are essentially achieved from the following two aspects. First, the steel is properly micro-alloyed to ensure particles precipitated pinning the grain at 600° C., thereby effectively inhibiting the microstructure from recrystallization. Second, while achieving high strength and high performance though adopting a low-carbon bainitic steel control technology, the stability of the microstructure and good weldability of the microstructure are further improved though using the medium temperature transition of bainite steel.

In the prior art, the alloying elements such as Nb, Mo, Cr, V and Ti are used to improve the high-temperature fire resistance of the steel. The joint addition of Nb and Mo is an effective way to improve the high-temperature performance of the steel. The roles of Ti element and V element in the fire-resistant steel are similar to that of Nb. They all have positive roles on the plasticity and toughness of the steel after welding while increasing the high-temperature strength of the steel. At present, the fire-resistant steels mainly include Mo—Nb, Mo—Nb—Ti, Mo—V and Mo—Cr—Nb—V steels. Low carbon content, high purity, micro-alloying and ultra-fine crystallization are the development trends of modern physical metallurgy. As a structural steel, the fire-resistant steel is a kind of steel for welding structure. In order to improve the weldability of steel, it is hoped that its carbon content is low to obtain good welding performance.

After searching, CN103710622A discloses an anti-seismic steel with a yield strength of 690 MPa grade and a low yield-to-tensile (Y/T) ratio and a manufacturing method thereof, whose chemical components by weight percentage are as follows: 0.05-0.13 wt % of C, 0.00-0.50 wt % of Si, 1.50-2.50 wt % of Mn, <0.012 wt % of P, <0.006 wt % of S, 0.15-0.50 wt % of Mo, 0.02-0.12 wt % of Nb, 0.00-0.15 wt % of V, 0.01-0.025 wt % of Ti, 0.0010-0.0030 wt % of B, 0.01-0.06 wt % of Al, and the balance is Fe and inevitable impurities. Besides, the steel is added with the following one or more alloying elements: 0.00-0.80 wt % of Cu, 0.00-0.50 wt % of Cr and 0.00-1.00 wt % of Ni. The total amount of the alloying elements added in the steel is not more than 5%. This steel grade is obtained through thermal mechanical control processing (TMCP) and isothermal heat treatment in a two-phase zone to obtain a low Y/T ratio anti-seismic steel with a yield strength of 690 MPa grape. The temperature control window in the two-phase zone is narrow, which makes it hard for the production process control. In addition, the steel does not have good fire resistance, which limits the actual production and promotion of this steel grades.

After searching, CN103695773A discloses a fire-resistant, weather-resistant and seismic-resistant construction steel with a yield strength of 690 MPa grape and a production method thereof, whose components and contents by weight percentage are as follows: 0.051-0.155% of C, 0.20-0.60% of Si, 1.82-2.55% of Mn, ≤0.008% of P, ≤0.002% of S, 0.081-0.090% of Nb, 0.010-0.025% of Ti, 0.41-0.60% of Mo, 0.08-0.10% of W, 0.0071-0.0095% of Mg, ≤0.0010% of O, and the balance is Fe and inevitable impurities. Besides, it is added with 0.08-0.1% of Sb or 0.08-0.12% of Zr or a mixture of the two in any ratio. The steel grape is produced through TMCP, but due to the high additions of W and Zr components and the design idea of high Nb+Ti is adopted, and the cost is high. The literature does not specify the microstructure state, but due to the relatively high Mn content, a bainite+martensite mixed structure will inevitably be generated in the hot rolled state. As the bainite/martensite ratio will be substantially affected by the change of the cooling rate, the stability of welding performance and low-temperature performance of the steel will be affected, especially the impact toughness at −40° C. of the steel needs to be further verified.

After searching, CN109628836A discloses a fire-resistant, weather-resistant and seismic-resistant construction steel with a yield strength of 690 MPa grape and a production method thereof, whose chemical components are as follows: 0.04-0.08% of C, 1.0-1.5% of Mn, 0.15-0.60% of Si, 0.2-0.7% of Cr, 0.10-0.60% of Mo, ≤0.35% of Ti+V+Nb, 0.01-0.05% of Al, 0.1-0.6% of Cu, 0.1-0.6% of Ni, ≤0.008% of P, ≤0.002% of S, and the balance is Fe and inevitable trace chemical elements. The mechanical properties, low-temperature properties and weather resistance of the disclosure are outstanding, but the production process of which is complicated and difficult to control. The rolling in this literature adopts the production process of medium and heavy plate mill control+laminar cooling. After rolling, the steel plate passes through the heat treatment process of quenching in the α+γ two-phase zone after heat preservation and tempering to adjust the structure ratio of the bainite, martensite and ferrite, so as to control the strength and Y/T ratio of the material. At the same time, the purpose of quenching in the α+γ two-phase zone after heat preservation is to dissolve a part of Nb, which will precipitate to control the performance of the steel plate in the subsequent high temperature fire process. Due to the different thickness and size specifications of the medium and heavy plates, the soaking time is different, the temperature process window is narrow when heating in the two-phase zone, and there are complex influencing factors such as large temperature difference between the inside and outside of the steel plate, so it will inevitably lead to the instability control of the microstructure ratio, and a huge technical problem that the fluctuation of the solid solution amount of Nb, which leads to the fluctuation of the fire resistance. Therefore, there are large technological bottlenecks in production and equipment that need to be broken through.

The technical progress in this technical field shows that: 690 MPa grade high-strength building structure steel usually reuses bainite or tempered martensite structure control technical solutions. And the addition of Mo, Nb, V, Ti and other elements is a very effective way to improve the high-temperature fire resistance of the steel. Therefore, for the high-strength building structural steel of 690 MPa grade, the present disclosure selects the air-cooled bainitic steel alloy system and adds optimized technical route of the combination of fire-resistant microalloying elements, while meeting high strength and toughness and long-term fire-resistant performance.

SUMMARY

In view of this, the present disclosure provides a high-strength low-carbon bainitic fire-resistant steel and a preparation method thereof. The present disclosure solves one of the following problems: (1) low yield strength, (2) complicated production process and (3) poor high-temperature mechanical properties of the fire-resistant steel in the prior art.

The present disclosure is achieved by a technical solution as follows:

A high-strength low-carbon bainitic fire-resistant steel, the chemical components of the fire-resistant steel by mass percent are as follows: 0.07-0.1% of C, 0.7-0.9% of Si, 1.0-1.5% of Mn, 0.7-0.8% of Cr, 1.0-1.3% of Ni, 0.3-0.35% of Cu, 0.6-0.8% of Mo, 0.025-0.035% of Nb, 0.09-0.15% of V, 0.01-0.015% of Ti, <0.2% of Nb+V+Ti, <0.02% of Al, <0.003% of S, <0.008% of P, and the balance is Fe and inevitable impurities.

Further, the chemical components of the fire-resistant steel by mass percent are as follows: 0.08-0.10% of C, 0.75-0.85% of Si, 1.1-1.5% of Mn, 0.7-0.78% of Cr, 1.0-1.25% of Ni, 0.3-0.34% of Cu, 0.6-0.75% of Mo, 0.025-0.032% of Nb, 0.09-0.14% of V, 0.01-0.013% of Ti, <0.18% of Nb+V+Ti, <0.02% of Al, <0.003% of S, <0.008% of P, and the balance is Fe and inevitable impurities.

A preparation method for the high-strength low-carbon bainitic fire-resistant steel, includes the following steps:

step 1: rolling a continuously casting slab or casting slab to obtain a medium and heavy steel plate; and step 2: subjecting the medium and heavy steel plate to a heat treatment to obtain a fire-resistant steel.

Further, step 1 may include the following steps:

step 11: loading the continuously casting slab or casting slab into a heating furnace for heating;

step 12: rolling the heated continuously casting slab or casting slab; and step 13: air-cooling or laminar-cooling the rolled continuously casting slab or casting slab to obtain a medium and heavy steel plate.

Further, in step 11, the continuously casting slab or casting slab is heated to 1,180-1,240° C. in the heating furnace, and soaking time is 1-4 h.

Further, in step 12, an initial rolling temperature of the continuously casting slab or casting slab is 1,150-1,200° C.; the rolling includes rough rolling and finish rolling; the rough rolling is performed in 3-6 passes, with a final rolling temperature of the rough rolling controlled at 950-1,100° C.; the finish rolling is performed in 5-10 passes, with a final rolling temperature of finish rolling controlled at 880-920° C.

Further, in step 13, the rolled continuously casting slab or casting slab is air-cooled or laminar-cooled to below 370° C.

Further, step 2 may include the following steps:

step 21: normalizing the medium and heavy steel plate; and step 22: air-cooling the normalized medium and heavy steel plate to room temperature, and then the tempering heat treatment is performed.

Further, the temperature range of normalizing of the medium and heavy steel plate is 880-920° C., soaking time after normalizing is 1-4 h, and the medium and heavy steel plate is air-cooled to room temperature after the normalizing soaking.

Further, the medium and heavy steel plate is tempered at 370-430° C., and soaking time is 1-3 h after tempering, and the medium and heavy steel plate is air-cooled to room temperature after the tempering soaking, then obtaining a finished fire-resistant steel.

Compared with the prior art, the present disclosure can realize at least one of the following beneficial effects:

1. Aiming at the shortcomings of production technology of the 690 MPa grade fire-resistant steel in the prior art. The present disclosure provides a high-strength low-carbon bainite fire-resistant steel, which is a low-alloy air-cooled bainite fire-resistant steel. By optimization and control of alloy composition, the production process is simple and convenient. The production process is hot rolling+normalizing+tempering production process. The properties of the fire-resistant steel obtained is: yield strength ≥690 MPa, yield-to-tensile (Y/T) ratio <0.85, which meets requirements the high temperature yield strength at 600° C. reaches ⅔ of the room temperature yield strength, and at the same time low-temperature impact toughness is greater than 69 J at −40° C. The fire-resistant steel can be widely used for anti-seismic, fire-resistant and low-temperature-resistant structures in various steel structure buildings.

2. Based on a low-C—Si—Mn—Cr air-cooled bainitic alloy system, the present disclosure adopts a high-V and low-Nb—Ti micro-alloying technology route, and the microstructure of the prepared steel is tempered bainite+residual austenite (or a small amount of residual martensite-austenite (MA) islands) structure. Normalizing is performed to control the components of the microstructure and the uniformity of the grain size. Tempering is performed to further eliminate the residual stress in the steel to improve the plasticity and toughness of the steel, and to decompose the larger residual austenite to improve the stability of the microstructure and properties. The grain structure is refined through the precipitation mechanism of Nb and Ti in the steel at the high-temperature stage in the austenite temperature zone to improve the plasticity and toughness of the steel. The V content is increased through the infinite solid solution mechanism of V and the bainitic ferrite, such that the fire-resistant steel in the alloy system of the present disclosure still retains sufficient solid solution V content in the lath-like bainitic ferrite and the residual austenite at room temperature. When the steel meets the high temperature of 600° C., it will dissolve with the trace amount Mo of solid solution in the steel, especially V, to strengthen the microstructure and pining the grains to inhibit their recrystallization and growth, and achieve the purpose of stabilizing the strength of the steel.

3. In the present disclosure, the hot rolling process of fire-resistant steel is as follows: the continuous casting slab or casting slab is heated to 1180-1240° C. for 1-4 hours, and then rolling, and the initial rolling temperature is 1150-1200° C.; the rolling process of medium and heavy plate rolling mill is: rough rolling 3-6 passes, finish rolling 5-10 passes, control the hot rolling temperature of fire-resistant steel, control the temperature after rough rolling at 950-1100° C., and the final rolling temperature of finish rolling is 880-920° C.; after the hot rolling, the medium and heavy plate is performed normalizing and tempering heat treatment. The normalizing temperature is set in the austenite temperature zone and the temperature range is 880-920° C.; the tempering temperature is set in the bainitic temperature zone and the tempering temperature is 370-430° C., and the finished fire-resistant steel is obtained, whose yield strength is ≥690 MPa, Y/T ratio is <0.85, which meets requirements the high temperature yield strength at 600° C. reaches ⅔ of the room temperature yield strength, and at the same time low-temperature impact toughness is greater than 69 J at −40° C. And it can be widely satisfied the anti-seismic requirements of various steel structure buildings.

4. The production process of the fire-resistant steel of the present disclosure is relatively simple. It adopts hot rolling, normalizing and tempering production processes, among which the heat treatment process of normalizing and tempering is directly adopted, which omits the process of quenching and annealing compared with the traditional steel heat treatment process, simplifying the production process and saving production costs, and the finished fire-resistant steel prepared by the present disclosure widely satisfies the anti-seismic requirements of various steel structure buildings.

The above technical solutions in the present disclosure may also be combined with each other to realize more preferred combination solutions. Other features and advantages of the present disclosure will be described in the following description, and some of these will become apparent from the description or be understood by implementing the present disclosure. The objectives and other advantages of the present disclosure may be implemented or derived by those specifically indicated in the description and accompanying drawings.

BRIEF DESCRIPTION OF THE DRAWINGS

The accompanying drawings are provided merely for illustrating the specific examples, rather than to limit the present disclosure. The same reference numerals represent the same components throughout the accompanying drawings.

DETAILED DESCRIPTION

Figure 1:
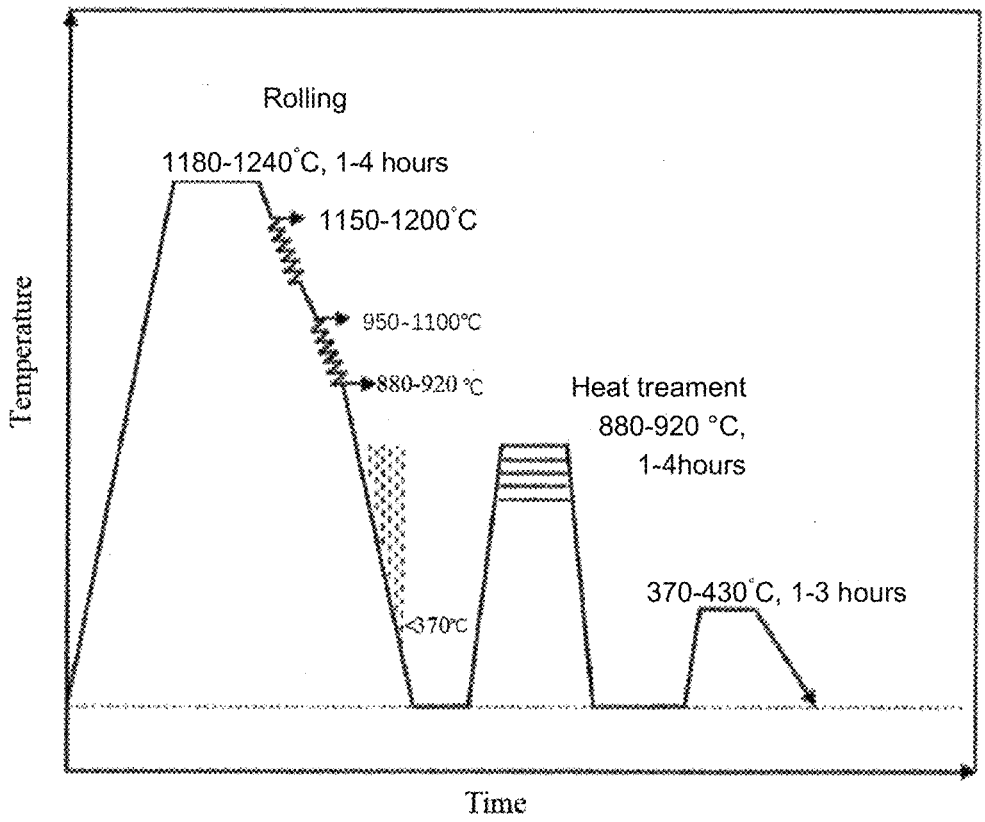
FIG. 1 shows a diagram of a rolling process and heat treatment process of a fire-resistant steel plate.
Figure 2:
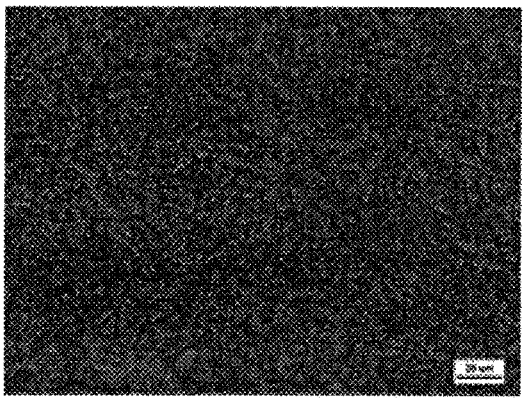
FIG. 2 shows a microstructure observed from an optical microscope after a heat treatment (tempering time 1 h) in Example 1.
Figure 3:
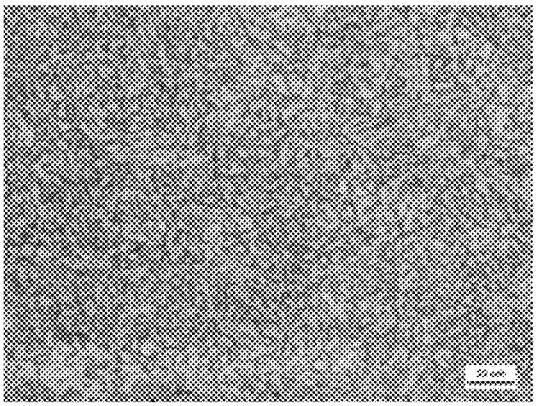
FIG. 3 shows a microstructure observed from an optical microscope after a heat treatment (tempering time 3 h) in Example 1.
Figure 4:
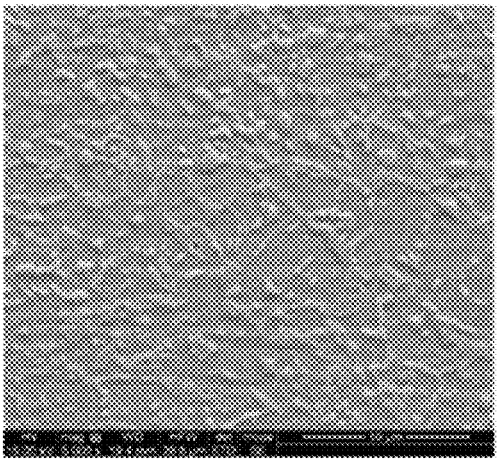
FIG. 4 shows a microstructure observed from a scanning electron microscope (SEM) after a heat treatment (tempering time 1 h) in Example 1.
Figure 5:
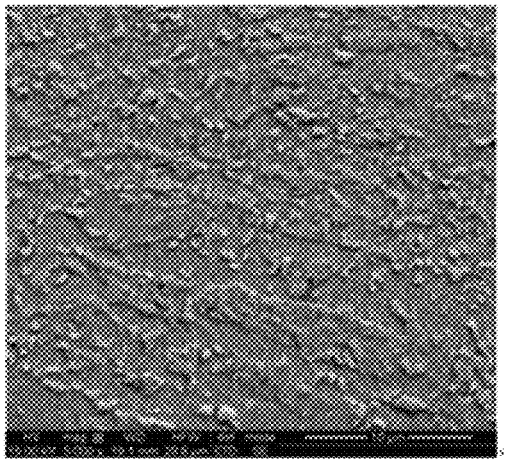
FIG. 5 shows a microstructure observed from an SEM after a heat treatment (tempering time 3 h) in Example 1.

The preferred examples of the present disclosure are described in detail below with reference to the accompanying drawings. As a part of the present disclosure, the accompanying drawings are used together with the examples of the present disclosure to explain the principles of the present disclosure, rather than to limit the scope of the present disclosure.

The present disclosure provides a high-strength low-carbon bainitic fire-resistant steel, whose chemical components by mass percent are as follows: 0.07-0.1% of C, 0.7-0.9% of Si, 1.0-1.5% of Mn, 0.7-0.8% of Cr, 1.0-1.3% of Ni, 0.3-0.35% of Cu, 0.6-0.8% of Mo, 0.025-0.035% of Nb, 0.09-0.15% of V, 0.01-0.015% of Ti, <0.2% of Nb+V+Ti, <0.02% of Al, <0.003% of S, <0.008% of P, and the balance is Fe and inevitable impurities.

In another specific example, the chemical components of the fire-resistant steel by mass percent are as follows: 0.08-0.10% of C, 0.75-0.85% of Si, 1.1-1.5% of Mn, 0.7-0.78% of Cr, 1.0-1.25% of Ni, 0.3-0.34% of Cu, 0.6-0.75% of Mo, 0.025-0.032% of Nb, 0.09-0.14% of V, 0.01-0.013% of Ti, <0.18% of Nb+V+Ti, <0.02% of Al, <0.003% of S, <0.008% of P, and the balance is Fe and inevitable impurities.

Based on a low-C—Si—Mn—Cr air-cooled bainitic alloy system, the present disclosure adopts a high-V and low-Nb—Ti micro-alloying technology route, and the microstructure of the steel is tempered bainite+residual austenite (or residual MA islands). The specific functions of the alloying elements in fire-resistant steel are as follows:

C: C is low in the low-carbon bainitic steel, and its function is to make the precipitation of carbide strengthened during the tempering process. The C content of the traditional low-carbon bainitic 690 MPa grade steel is controlled below 0.06%, and the purpose is to not form upper bainite and cementite in the transformation product to ensure the welding performance of the steel. The present disclosure increases the C content and aims to ensure that there is sufficient carbon content to promote the precipitation of high-temperature carbides at 600° C. In the present disclosure, the high Si content suppresses the diffusion of C to hinder the formation of the cementite, so as to improve the weldability of the steel, and at the same time, the ferrite/pearlite transformation zone and the bainite transformation zone are separated by adding Mn and Mo, and a certain amount of MA islands is retained in the steel, and this part of MA islands adjusts the stability of the size and performance of the steel through the subsequent low-temperature tempering process. In the present disclosure, the content of C element is 0.07-0.1%.

Si: The Si content in the traditional high-strength low-carbon bainitic steel is low. The present disclosure utilizes the mechanism that Si inhibits C diffusion to hinder the formation of cementite in the bainite lath. On the other hand, the present disclosure utilizes the mechanism that Si exists in ferrite or austenite in the form of solid solution, and has a strong solid solution function to improve the normal-temperature and high-temperature strength of the steel. Therefore, in the present disclosure, the Si content is preferably 0.7-0.9%.

Mn: As a main alloying element in the present disclosure, Mn forms a solid solution with Fe to improve the hardness and strength of ferrite and austenite in the steel. The ability of Mn to stabilize austenite structure is second only to Ni, and it also strongly increases the hardenability of the steel and promotes the phase transformation of bainite. However, if the Mn content is too high, that is, >1.6%, or the hardenability of the steel is greatly improved, it is easy to cause segregation of Mn or the presence of martensite structure in the steel formation, which will affect the performance stability of the steel. In the present disclosure, the Mn content is preferably 1.0-1.5%.

Mo: Mo is an essential component in the fire-resistant steel. The strengthening mechanism in steel includes solid solution strengthening and precipitation strengthening. Mo can significantly improve the high-temperature creep and durability of steel, so an increase of the Mo content can make the fire-resistant steel have better high-temperature fire resistance. Mo and interstitial elements (C, N) have a significant interaction to achieve solid solution strengthening, and the joint addition of 0.01% of C or N and 0.5% of Mo can significantly improve the high-temperature creep and durability of steel. The main purpose is to form more fine and stable carbides ($Mo_2C$) at high temperatures to achieve the purpose of pinning grains to inhibit their recrystallization and growth and improve strength. Because of the large solid solubility of Mo in steel, therefore it is easy to use the mechanisms that aging precipitation of Mo at high temperature to make the steel have good fire resistance. Mo improves the hardenability, and is to promote the bainite structure to form element, which facilitates obtaining the air-cooled bainitic steel. Meanwhile, Mo can push up the temper brittleness temperature of the bainitic steel, and make the air-cooled bainitic steel have a larger tempering process adjustment window. However, the addition of Mo will increase the production cost, so in the present disclosure, the Mo content is controlled at 0.6-0.8%.

Cr: Cr is a main element in the air-cooled bainitic alloy system of the present disclosure, Cr can improve the hardenability of the steel and promote the formation of the air-cooled bainite. Cr works together with Mo, Cu, and Ni to improve the corrosion resistance of the steel. In the present disclosure, the content of Cr is 0.7-0.8%.

Ni: Ni can increase the strength of the steel without significantly reducing the toughness. It can reduce the brittle transition temperature of steel, that is to say, Ni can improve the low-temperature toughness of the steel, and improve the workability and weldability of the steel. Ni can improve the corrosion resistance of the steel, not only acid resistance, but also alkali and atmospheric corrosion. In the present disclosure, the Ni content is preferably 1.0-1.3%.

Cu: When Cu is added to steel, it can replace part of Ni to improve the hardenability of steel and its solid solution strengthening effect. Depending on the age hardening of Cu, high strength, especially Y/T ratio, can be obtained without causing obvious damage to the plasticity and toughness. It has no adverse effects on welding and toughness, and can improve the low-temperature toughness and weather resistance of the steel. Due to the low melting point, excessively high Cu in the steel is prone to cracking during hot working. Therefore, it is necessary to eliminate the hot cracking tendency of Cu-containing steel through high Ni. At the same time, Cu does not form carbide particles with C. The aging precipitation temperature of Cu is 500-600° C., which is precipitation strengthening in the form of Cu particles. In the present disclosure, the Cu content is 0.3-0.35%.

Nb: Nb can combine with C, Ni and O to form extremely stable compounds. It is usually precipitated in the high-temperature austenite to refine grains, reducing the overheating sensitization and temper brittleness of the steel. The joint addition of Nb and Mo can promote and the precipitation of Mo at high temperature and improve the fire resistance of the steel. Therefore, the design of fire-resistant steel usually uses a high Nb content (>0.06%) to replace part of Mo. However, the design idea that using Nb and Mo precipitate alloy by fire will increase the complexity of production process control. It is needed to adopt high-temperature solid solution and two-phase zone partition tempering process to ensure a considerable amount of Nb solid solution in the steel. The process window for the two-phase zone tempering is narrow, which is not conducive to the stability of mass production. Therefore, the present disclosure only uses the high-temperature precipitation of Nb to refine the austenite grains and suppress the size of the bainite laths after cooling phase transformation. In the present disclosure, the Nb content is relatively low, which is 0.025-0.035%.

Ti: A small amount of Ti element precipitates at high temperature to form dispersed fine second-phase particles in the steel, which are pinned in the austenite grain boundaries, inhibiting the growth of austenite in the heat-affected zone and improving the plasticity and toughness of the steel after welding. As a commonly used micro-alloying element in fire-resistant steel, Ti is added in combination with Nb for precipitation strengthening. Typically, Ti can be added up to 0.25%. However, an excessively high Ti content will cause mixed precipitation of different forms of Ti particles such as nitride, carbide and oxide, which will affect the effective Ti performance and microscopic grain size fluctuations. In the present disclosure, the Ti content is 0.01-0.015%.

V: A small amount of V in the steel has the characteristics of solid solution strengthening, fine grain strengthening and precipitation strengthening. Typically, V has an infinite solid solution mechanism with austenite or ferrite, and at the same time V (NC) can be precipitated in austenite and bainite ferrite laths. The carbide of V has good stability at high temperature and is not easy to dissolve and grow. At the same time, the carbide formed by V and C can keep coherent with the matrix, and can generate a strong stress field to prevent the movement of dislocations and improve the high-temperature performance of the steel. By using the full solid solution of V in the steel and the precipitation at 600° C. in fire to hinder the grain recrystallization and growth control of the performance mechanism of the steel plate, the design of high V content can be adopted in the design of the fire-resistant steel to ensure the fire resistance of the weathering steel. In the present disclosure, the V content is controlled to 0.09-0.15%.

P, S: P and S are often regarded as impurity elements in the steel. Clean steel will effectively reduce the contents of P and S, but it will increase the cost of steelmaking. Therefore, in the present disclosure, the contents of P and S are $P \leq 0.008\%$ and $S \leq 0.003\%$, respectively.

The present disclosure specifies the total content range of the micro-alloying elements is $Nb+V+Ti<0.2\%$ so as to control the total precipitation amount of microalloy particles during heat treatment to ensure the steel has sufficient carbide precipitation and reduce the total amount of Nb+V when they encounter fire. And the total amount of Nb+V is too high to affect the welding performance.

The present disclosure adopts the design principle of a low Al content ($Al<0.02\%$). Al is a deoxidizer, but Al has an adverse effect on the low-temperature toughness and high-temperature strength of the steel. Therefore, the present disclosure limits the content of Al.

Another aspect of the present disclosure provides a preparation method for the high-strength low-carbon bainitic fire-resistant steel. As shown in FIG. 1, the preparation method includes the following steps:

Step 1: Roll a continuously casting slab or casting slab to obtain a medium and heavy steel plate.

The continuously casting slab or casting slab is loaded into a heating furnace for heating, heated to 1,180-1,240° C., and soaking time is 1-4 h, and rolled the heated continuously casting slab or casting slab. An initial rolling temperature of the continuously casting slab or casting slab is 1,150-1,200° C. The rolling process is as follows: the rough rolling is performed in 3-6 passes, with a final rolling temperature of rough rolling controlled at 950-1,100° C. The finish rolling is performed in 5-10 passes, with a final rolling temperature of finish rolling controlled at 880-920° C. The rolled continuously casting slab or casting slab is air-cooled or laminar-cooled to below 370° C. to obtain a medium and heavy plate.

Step 2: Subject the medium and heavy steel plate after rolling to a heat treatment to obtain a fire-resistant steel.

After the hot rolling, the medium and heavy plate is performed normalizing and tempering heat treatment. The normalizing temperature is in the austenite temperature zone, and the temperature range of the normalizing treatment is 880-920° C., soaking time is 1-4 h, and then air-cooled to room temperature. The tempering temperature of the medium and heavy plate is in the bainitic temperature zone, and the tempering temperature is 370-430° C., soaking time is 1-3 h, and then air-cooled to room temperature to obtain a finished fire-resistant steel. The grain structure is refined through the precipitation mechanism of Nb and Ti in the steel at the high-temperature stage in the austenite temperature zone to improve the plasticity and toughness of the steel. The steel still retains a sufficient solid solution V content in the lath-like bainitic ferrite and the residual austenite at room temperature through the infinite solid solution mechanism of V and the bainitic ferrite. V and a small amount of solid-solution Mo and Nb can be coordinated to precipitate a second time at a high temperature of 600° C. to strengthen and pinning the grain, and achieve the purpose of stabilizing the strength of the steel.

Figure 6:
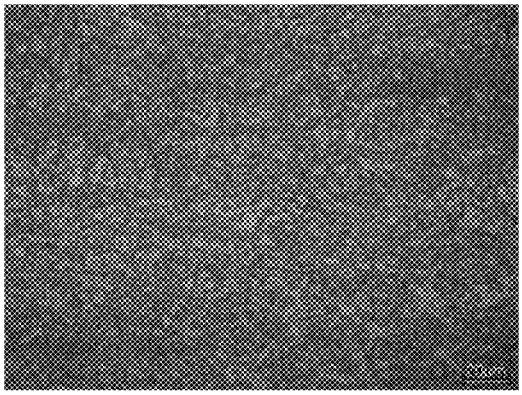
FIG. 6 shows a microstructure observed from an optical microscope after a heat treatment (tempering time 1 h) in Comparative Example 1.
Figure 7:
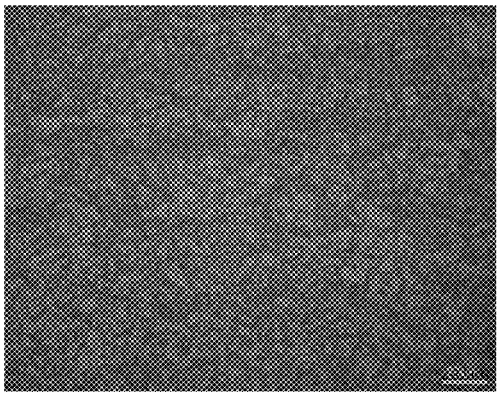
FIG. 7 shows a microstructure observed from an optical microscope after a heat treatment (tempering time 3 h) in Comparative Example 1.

In particular, in order to keep the residual stress of the steel at a low level and the overall performance of the steel to be uniform, a secondary tempering process can be used. Normalizing is performed to control the components of the microstructure and the uniformity of the grain size of the fire-resistant steel. Tempering is performed to further eliminate the residual stress in the steel so as to improve the plasticity and toughness of the steel, and to decompose the larger residual austenite so as to improve the stability of the microstructure and properties. As shown in FIGS. 2 to 5, the microstructure of the fire-resistant steel prepared in Example 1 is tempered bainite+residual austenite (a small amount of martensite-austenite structure) structure. As shown in FIGS. 6 to 7, the matrix structure of the fire-resistant steel in Comparative Example 1 is different from that in Example 1, and the grain structure of the fire-resistant steel in Example 1 is finer.

The content of each element of the fire-resistant steel in the specific examples of the present disclosure is shown in Table 1, and the preparation method of the fire-resistant steel is shown in Table 2. Compared with Examples 1 to 3, Comparative Example 1 adopts a design scheme of increasing the content of Nb and Ti elements and reducing the content of V. The content of each element of the fire-resistant steel in the comparative example is shown in Table 1, and the preparation method of the fire-resistant steel is shown in Table 2.

TABLE 1

Element content (wt %) of examples of the present disclosure and comparative examples

| Implementations | C | Si | Mn | Cr | Ni | Mo | Cu | Nb | Ti | V | Al | S | P |
|---|---|---|---|---|---|---|---|---|---|---|---|---|---|
| Example 1 | 0.1 | 0.73 | 1.0 | 0.73 | 1.25 | 0.6 | 0.3 | 0.035 | 0.015 | 0.09 | 0.012 | 0.0026 | 0.0047 |
| Example 2 | 0.07 | 0.75 | 1.5 | 0.78 | 1.25 | 0.7 | 0.35 | 0.025 | 0.010 | 0.14 | 0.012 | 0.0026 | 0.0047 |
| Example 3 | 0.08 | 0.08 | 1.2 | 0.75 | 1.3 | 0.75 | 0.32 | 0.03 | 0.010 | 0.15 | 0.012 | 0.002 | 0.006 |
| Example 4 | 0.09 | 0.09 | 1.3 | 0.8 | 1.0 | 0.8 | 0.34 | 0.028 | 0.012 | 0.12 | 0.012 | 0.002 | 0.006 |
| Comparative Example 1 | 0.08 | 0.78 | 1.0 | 0.78 | 1.25 | 0.57 | 0.4 | 0.062 | 0.025 | 0.04 | 0.03 | 0.0028 | 0.0087 |

TABLE 2

Rolling and heat treatment process of examples of the present disclosure and comparative examples

| | Rolling and heat treatment process | | | | |
|---|---|---|---|---|---|
| Implementations | Heating temperature (° C.)/ soaking time (h) of casting slab | Initial rolling temperature (° C.) | Final rolling temperature of rough rolling (° C.) | Final rolling temperature of finish rolling (° C.) | Temperature after laminar cooling (° C.) |
| Example 1 | 1180/3 | 1150 | 950 | 880 | 340 |
| Example 2 | 1240/3 | 1200 | 1100 | 920 | 370 |
| Example 3 | 1200/3 | 1170 | 1070 | 900 | 350 |
| Example 4 | 1210/3 | 1180 | 1080 | 890 | 360 |
| Comparative Example 1 | 1240/3 | 1200 | 1100 | 920 | 370 |

Table 3 shows mechanical properties, low-temperature impact performance and 600° C. fire resistance of Examples 1 to 4 of the present disclosure and Comparative Example 1.

Table 3 Heat treatment process and performance of examples of the present disclosure and Comparative Example 1

| Heat treatment process | Tensile strength/ MPa | Yield strength/ MPa | Y/T ratio | Elongation/ % | Reduction of area/% | 600° C. yield strength/ MPa | −40° C. impact energy/J |
|---|---|---|---|---|---|---|---|
| Example 1 | | | | | | | |
| 910° C. * 1 hAC + 400° C. * 1 hAC | 888 | 755 | 0.85 | 18.5 | 66 | 481 | 167/176/94 |
| 910° C. * 1 hAC + 400° C. * 3 hAC | 908 | 745 | 0.82 | 17.5 | 67 | 482 | 69/124/78 |
| Example 2 | | | | | | | |
| 890° C. * 1 hAC + 380° C. * 1 hAC | 918 | 775 | 0.84 | 15.5 | 56 | 491 | 157/146/94 |
| 890° C. * 1 hAC + 380° C. * 3 hAC | 932 | 765 | 0.82 | 15.5 | 57 | 492 | 69/114/88 |
| Example 3 | | | | | | | |
| 900° C. * 1 hAC + 430° C. * 1 hAC | 878 | 735 | 0.84 | 17.5 | 57 | 471 | 157/156/104 |
| 900° C. * 1 hAC + 430° C. * 3 hAC | 882 | 745 | 0.84 | 16.5 | 51 | 472 | 82/114/98 |
| Example 4 | | | | | | | |
| 900° C. * 1 hAC + 430° C. * 1 hAC | 898 | 745 | 0.83 | 17.5 | 62 | 485 | 168/175/99 |
| 900° C. * 1 hAC + 430° C. * 3 hAC | 922 | 755 | 0.82 | 16.5 | 65 | 483 | 78/121/83 |
| Comparative Example 1 | | | | | | | |
| 910° C. * 1 hAC + 380° C. * 1 hAC | 1013 | 765 | 0.76 | 17.5 | 61 | 459 | 74/24/16 |
| 910° C. * 1 hAC + 380° C. * 3 hAC | 1059 | 677 | 0.64 | 15 | 62 | 432 | 20/42/57 |

Combining Table 1, Table 2 and Table 3, it can be concluded that the present disclosure adopts a high-V and low-Nb—Ti micro-alloying technology route. The grain structure is refined through the precipitation mechanism of Nb and Ti in the steel at the high-temperature stage in the austenite temperature zone to improve the plasticity and toughness of the steel. The steel still retains a sufficient solid solution V content in the lath-like bainitic ferrite and the residual austenite at room temperature through the infinite solid solution mechanism of V and the bainitic ferrite. V and a small amount of solid-solution Mo and Nb can be coordinated to precipitate a second time at a high temperature of 600° C. to strengthen and pinning the grain, to improve the strength of the steel.

The above are merely preferable particular embodiments of the present disclosure, and the protection scope of the present disclosure is not limited thereto. Any modification or replacement easily conceived by those skilled in the art within the technical scope of the present disclosure should fall within the protection scope of the present disclosure.

What is claimed is:

1. A preparation method for a high-strength low-carbon bainitic fire-resistant steel comprising the following steps:

step 1: rolling a slab to obtain a steel plate; and step 2: subjecting the steel plate to a heat treatment to obtain a fire-resistant steel;

wherein the high-strength low-carbon bainitic fire-resistant steel comprises the following chemical components by mass percent: 0.07%-0.1% of C, 0.7%-0.9% of Si, 1.0%-1.5% of Mn, 0.7%-0.8% of Cr, 1.0%-1.3% of Ni, 0.3%-0.35% of Cu, 0.6%-0.8% of Mo, 0.025%-0.035% of Nb, 0.09%-0.15% of V, 0.01%-0.015% of Ti, <0.2% of Nb+V+Ti, <0.02% of Alt, <0.003% of S, <0.008% of P, and the balance is Fe and inevitable impurities, wherein step 1 comprises:

step a: loading the slab into a heating furnace for heating to obtain a heated slab;

step b: rolling the heated slab to obtain a rolled slab; and step c: control-cooling the rolled slab to obtain a steel plate; and wherein in step a, the slab is heated to 1180-1240° C. in the heating furnace, and soaked for 1-4 h.

2. The method of claim 1, wherein in step b, an initial rolling temperature of the slab is 1,150-1,200° C.; the rolling comprises rough rolling and finish rolling; the rough rolling is performed in 3-6 passes, with a final rolling temperature of the rough rolling controlled at 950-1,100° C.; the finish rolling is performed in 5-10 passes, with a final rolling temperature of the finish rolling controlled at 880-920° C.

3. The method of claim 1, wherein in step c, the rolled slab is control-cooled to below 370° C.

4. The of claim 1, wherein the step 2 comprises the following steps:

step i: normalizing the steel plate; and step: ii air-cooling the normalized steel plate to room temperature, and then the tempering heat treatment is performed.

5. The method of claim 4, wherein the steel plate is normalized at 880-920° C., soaked for 1-4 h after normalizing, and air-cooled to room temperature.

6. The method of claim 4, wherein the steel plate is tempered at 370-430° C., soaked for 1-3 h after tempering, and air-cooled to room temperature to obtain a finished fire-resistant steel.

* * * * *